United States Patent [19]

Velie

[11] 4,134,719

[45] Jan. 16, 1979

[54] MULTI-FLAME FUEL BURNER FOR LIQUID AND GASEOUS FUELS

[76] Inventor: Wallace W. Velie, 520 W. Emerson St., Upland, Calif. 91786

[21] Appl. No.: 726,795

[22] Filed: Sep. 27, 1976

[51] Int. Cl.[2] ..... F23M 9/06

[52] U.S. Cl. ..... 431/171; 431/286; 431/347; 239/422; 239/416.1; 239/424; 239/524

[58] Field of Search ..... 431/347, 284, 171, 180, 431/286; 239/422, 426, 400, 416.1, 424, 524

[56] References Cited

U.S. PATENT DOCUMENTS

| | | | |
|---|---|---|---|
| 1,241,135 | 9/1917 | Mastenbrook | 239/400 |
| 1,400,657 | 12/1921 | Brodie | 239/422 |
| 1,435,991 | 11/1922 | Stevenson et al. | 239/400 |
| 2,287,246 | 6/1942 | Hess | 431/180 |
| 2,393,887 | 1/1946 | Clements | 239/416.1 |
| 2,466,100 | 4/1949 | Harrah | 239/416.1 |
| 2,630,461 | 3/1953 | Sachsse et al. | 431/89 |
| 2,964,103 | 12/1960 | Ryder | 431/264 |
| 3,754,853 | 8/1973 | Braucksiek et al. | 431/347 |
| 3,843,309 | 10/1974 | Lambiris | 431/284 |
| 3,847,537 | 11/1974 | Velie | 431/347 |
| 3,909,188 | 9/1975 | Velie | 431/347 |
| 4,025,282 | 5/1977 | Reed | 431/328 |

FOREIGN PATENT DOCUMENTS

| | | | |
|---|---|---|---|
| 1395430 | 3/1965 | France | 431/286 |

*Primary Examiner*—Carroll B. Dority, Jr.
*Attorney, Agent, or Firm*—Fleit & Jacobson

[57] ABSTRACT

A multi-flame fuel burner comprises a plurality of air-atomizing fuel nozzles and sources of pressurized gas and liquid and gaseous fuels associated with each nozzle. A flame spreader is employed in combination with each air-atomizing nozzle to stabilize and shape the flame. The number of nozzles and associated flame spreaders are set to provide the desired burn rate.

9 Claims, 5 Drawing Figures

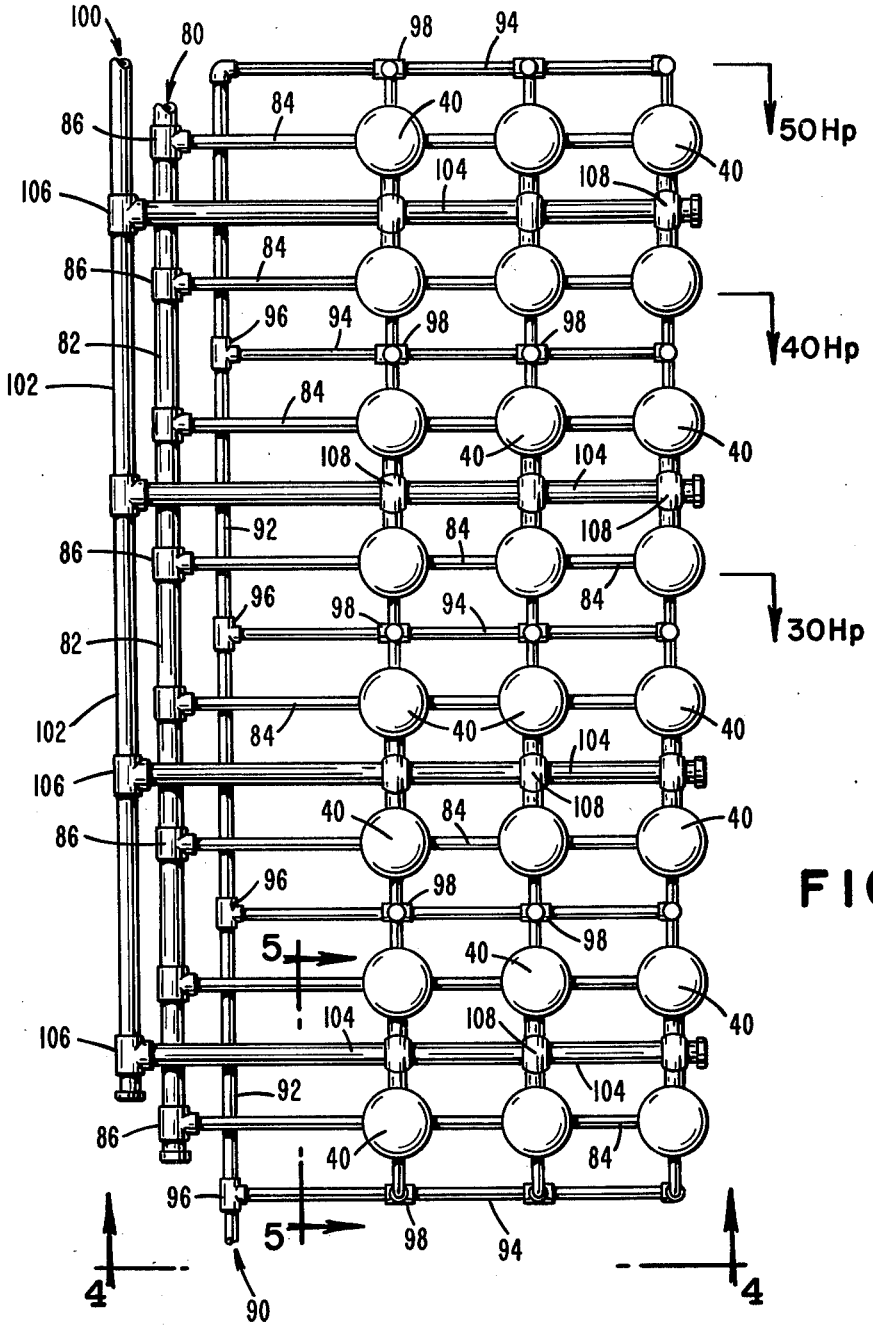
FIG. 3
FIG. 4
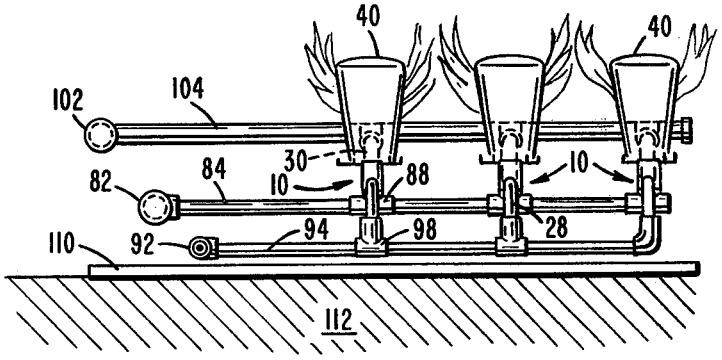
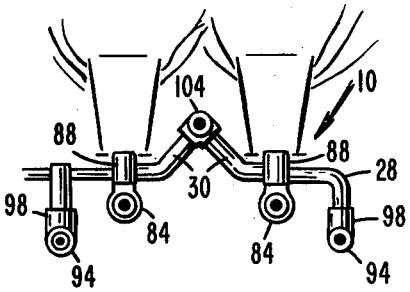
FIG. 5

MULTI-FLAME FUEL BURNER FOR LIQUID AND GASEOUS FUELS

CROSS-REFERENCE TO RELATED PATENT

This application is related to my U.S. Pat. No. 3,909,188.

BACKGROUND OF THE INVENTION

A fuel nozzle is essential to most fuel burners and consists of a device to prepare the fuel, gaseous or liquid, for efficient combustion. These devices have a variety of configurations, depending upon the physical characteristics of the fuel being consumed.

Almost exclusively, gaseous fuel nozzles consist of simple metering devices or orifices. Gas under its natural or supply system pressure is forced through the orifice, downstream of which is usually a tube to conduct the naturally aspirated mixture of fuel and entrapped air to a burner head. By contrast, liquid fuel nozzles typically use high fuel pressure and swirl and mechanical techniques to create a spray which is directed into the burner where it is mixed with a forced supply of air and burned. A disadvantage of prior art gaseous and liquid fuel nozzles is that they have functionally different designs for fundamentally different processes and therefore are not mutually interchangeable.

There is an increasing need for burners having multiple fuel capability, particularly those which can burn gaseous as well as liquid fuels. Moreover, there is a growing need for dual fuel burners for larger commercial or indistrial sized heating appliances, particularly in view of the increasing uncertainties about the availability of fuels. For example, a burner which can consume liquid fuels in a manner approximating gaseous fuels (i.e., natural convection combustion) is of particular interest since it can replace gas burners in applications which rely solely upon gaseous energy sources. In particular, gas burners for industrial processes such as boilers, hearths, heat treatment, and baking are candidates for dual fuel burners.

Accordingly, it is an object of this invention to utilize the characteristics of a pneumatic type atomizer to provide a simple burner which is capable of burning gaseous as well as liquid fuels and which has multiple nozzles or flame heads to increase the output of the burner assembly.

It is a further object of this invention to provide a burner which, in its simplest form, comprises a plurality of air-atomizing nozzles and sources of pressurized gas and liquid and gaseous fuels associated with each nozzle.

It is a still further object of this invention to provide a multi-flame fuel burner which will distribute heat evenly over the heat transfer surface.

Yet another object of this invention is to provide a multi-flame fuel burner which is naturally aspirating.

Still another object of this invention is to provide a multi-flame fuel burner which is cpable of cross-ignition among flame heads from a single ignited flame head.

Another object of this invention is to provide a multi-flame fuel burner which produces exceptionally clean and high temperature combustion products for application heating efficiency.

Still further objects and advantages of this invention will become apparent upon reading the following specification and claims, taken in conjunction with the accompanying drawings.

SUMMARY OF THE INVENTION

A simple multi-flame fuel burner is provided having a plurality of air-atomizing nozzles, a source of pressurized gas for dispersion of the fuel, sources of liuid and gaseous fuels, and regulators as required for regulating the flow of pressurized gas and fuel to the air-atomizing nozzles. A valve is provided in the delivery line to the nozzles from the source of each of the liquid and gaseous fuels to select the type of fuel (i.e., liquid or gaseous) to be delivered to the nozzles. Suitable means may be optionally provided in the lines from the gas and liquid and gaseous fuel supplies to regulate the air and fuel pressures to the air-atomizing nozzles. Also, a flame spreader may be employed downstream of the nozzles to stabilize and shape the flames.

BRIEF DESCRIPTION OF THE DRAWINGS

FIG. 3 is a plan view of the multi-flame fuel burner of this invention including a plurality of air-atomizing nozzles and having a dual fuel burning capability;

FIG. 4 is a vertical end view of the multi-flame fuel burner of FIG. 3 taken in the direction of arrows 4—4; and FIG. 5 is a partial vertical side view of the multi-flame fuel burner of FIG. 3 taken in the direction of arrows 5—5.

DESCRIPTION OF THE PREFERRED EMBODIMENTS

Figure 1:
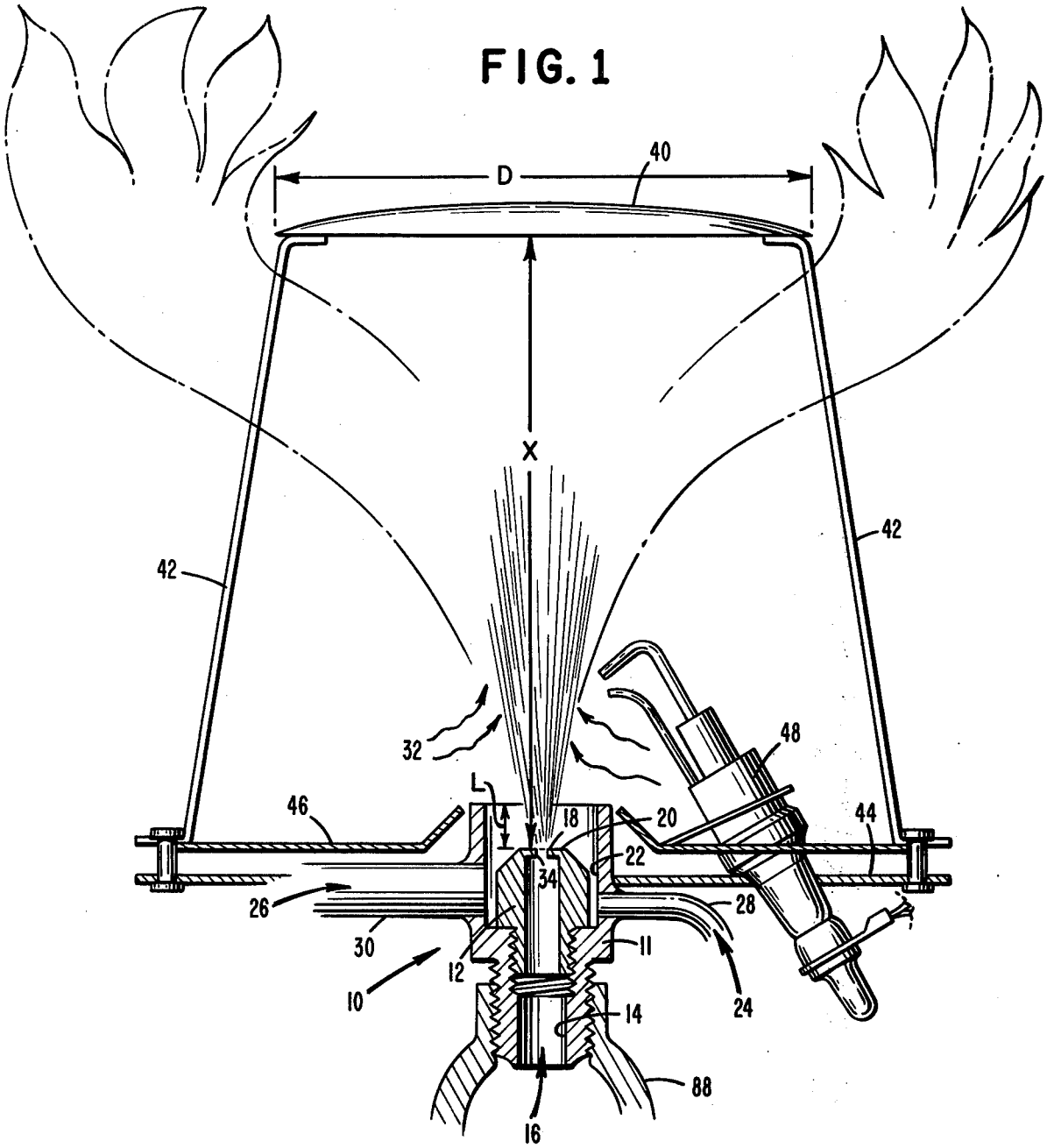
FIG. 1 shows one of the plurality of air-atomizing nozzles of this invention.

Referring to FIG. 1, the fuel atomizer comprises an air-atomizing nozzle 10 having an open ended atomizer housing 11 containing a compressible flow nozzle 12 at the terminus of an air or gas conduit 14 and so constructed that when a compressed gas 16 is expanded through the aperture 18 a region is created in the vicinity of surfaces 20 and 22 such that liquid or gaseous fuel 24 and 26 introduced through conduits 28 and 30, respectively, adjacent to surfaces 20 and 22 is efficiently and completely dispersed along with ambient air 32.

The specific dimensions of the air-atomizing nozzle 10 are important to effective performance of the nozzle using both liquid and gaseous fuels. These dimensions are set forth in detail in my U.S. Pat. No. 3,909,188, the disclosure of which is expressly incorporated herein by reference. Briefly, the thickness of the edge 34 of air aperture 18 is desirably less than the hydraulic diameter (i.e., aperture area ÷ aperture perimeter) of air aperture 18. Furthermore, the ratio of the mean diameter of gas conduit 14 to the hydraulic diameter of air aperture 18 should be greater than approximately 10.

The best hydraulic diameter for air aperture 18 is between about 10 and 30 thousandths of an inch and the preferred thickness of edge 34 is about 5 thousandths of an inch. The exit area of atomizing housing 11 should be less than about 0.4 square inch for a liquid fuel dispersion rate of about 1 g.p.h. At the same time, the exit area should not be so small that operation on gaseous fuel produces excessive exit velocity.

The length (L) of the open end of the atomizer housing 11 above air aperture 18 should be minimized to enhance aspiration of the ambient air at the housing exit. Approximately one-fourth inch or less has been found to be acceptable for this length (L). Concurrently, the fuel inlets should be as far below the aperture end of nozzle 12 as practical to avoid surface disturbance of liquid fuel and to uniformly distribute gaseous fuels around nozzle 12 prior to dispersion. On the other hand, an open ended atomizer body is not a mandatory requirement of a pneumatic type atomizer and adequate performance is possible by placing fuel conduits 28 and 30 close to surface 20 and adjacent to the aperture 18.

Still referring to FIG. 1, flame spreader 40 can be formed from any conventional material such as stainless steel or ceramics. Flame spreader 40 is generally disc-shaped and typically has a flat, planar or convex flame engaging surface. Flame spreader 40 may be supported relative to the air-atomizing nozzle by legs 42 attached to burner base 44. Above the burner base 44 and attached to it as an optional flame shield 46. Ignitor 48 is attached to burner base 44 and is of conventional design, such as a high voltage spark ignitor. Although more than one ignitor may be employed, only one is required in the over-all multi-flame fuel burner shown in FIGS. 3–5 because the system is capable of cross-ignition among nozzles or flame heads from a single ignited flame head.

During operation, primary air from gas conduit 14 disperses the fuel from liquid or gaseous fuel conduits 28 and 30, respectively, into fine particles or a mist as it expands through air aperture 18 of nozzle 12. These fine particles or mist are mixed with secondary air 32 which is drawn into the system above the atomizer by natural aspiration. The sprayed fuel is ignited by ignitor 48 or by cross-ignition from an adjacent nozzle and the resulting flame directed perpendicular to flame spreader 40. At flame spreader 40, the flame is stabilized and shaped, the upper surface of flame shield 46 acting as a radiation shield.

Flame spreader 40 should be positioned perpendicular to the air-atomizing nozzle and approximately centered (i.e., within about 0.25 inch) on the nozzle. For optimum combustion, flame spreader 40 should be in the gaseous or hydroxyl type combustion zone. This zone is downstream from the drop vaporization zone and upstream from the yellow flame or carbonaceous combustion zone. For optimum burning characteristics for most burner applications, it has been found best to use a ratio of flame spreader diameter (D) to axial separation distance (X) of about 1. Further details with respect to the flame spreader and ignitor are found in my U.S. Pat. No. 3,909,188.

Figure 2:
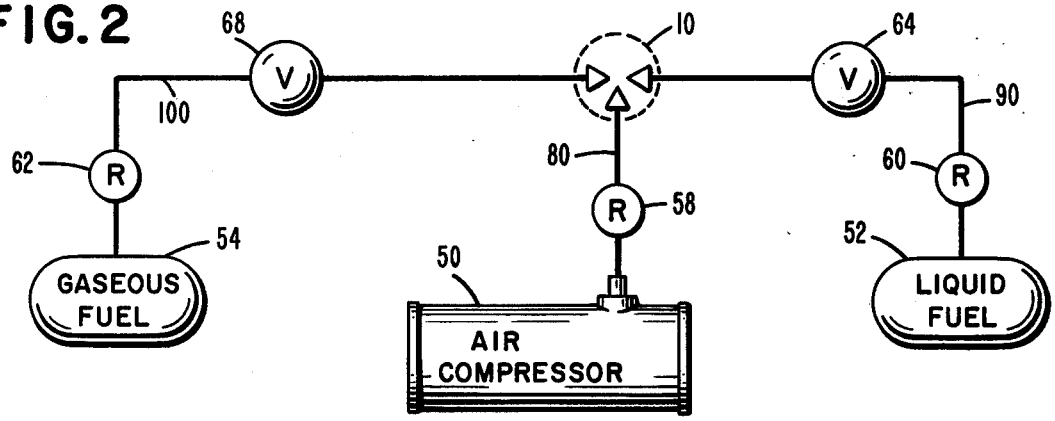
FIG. 2 shows an embodiment of this invention illustrating the relationship of the major components including one of the plurality of air-atomizing nozzles.

FIG. 2 is a schematic representation of an embodiment of the present invention but showing only one of the plurality of air-atomizing nozzles for ease of illustration. Broadly speaking, the fuel burner includes a source of pressurized gas, specifically illustrated as air compressor 50, for dispersion of the fuel, sources of liquid and gaseous fuels, 52 and 54, respectively, an air-atomizing nozzle 10, and regulators 58, 60 and 62 for regulating, if necessary, the flow of pressurized gas and liquid and gaseous fuels, respectively, to the air-atomizing nozzle. A valve 64 is provided in the delivery line from the source of liquid fuel 52 to the nozzle 10 and a similar valve 68 in the delivery line from the source of gaseous fuel 54 to the nozzle 10 to select the type of fuel (i.e., liquid or gaseous) delivered to the nozzle.

A preferred embodiment of the over-all multi-flame fuel burner is shown in FIGS. 3–5 and comprises a plurality of air-atomizing nozzles 10 and associated flame spreaders 40 such as shown in FIG. 3. Each air-atomizing nozzle 10 is attached to a gas or air manifold system 80 which supplies compressed air, for example, for the atomizer. Air manifold system 80 includes main air conduit or line 82 and a plurality of secondary air conduits or lines 84 attached to the main air line by fittings 86. In the embodiment illustrated, three air-atomizing nozzles 10 are attached to each secondary air line by means of fittings 88 although it will be appreciated that any number of nozzles may be employed.

The liquid fuel is supplied to the nozzles 10 through liquid fuel manifold system 90 which includes main and secondary liquid fuel conduits or lines 92 and 94, respectively, connected together by fittings 96. The secondary liquid fuel lines 94 are in turn attached to conduits 28 of air-atomizing nozzles 10 via fittings 98.

In like manner, the gaseous fuel is supplied through gaseous fuel manifold system 100 comprising main and secondary gaseous fuel conduits or lines 102 and 104, respectively, connected together by fittings 106. Secondary gaseous fuel lines 104 are in turn connected to conduits 30 of air-atomizing nozzles 10 via fittings 108.

The operation of the multi-flame fuel burner system is essentially the same as described above with reference to FIGS. 1 and 2. The air-atomizing nozzles 10 may be arranged in any desired configuration and spacing depending on the installation (e.g., boiler) in which they are to be used. A typical spacing is a uniform spacing of about 7/½ inches between the centers of the nozzles. The number of nozzles may be varied to meet the burn rate requirements of the particular application, for example, for a 30 Hp, 40 Hp or 50 Hp boiler as indicated in FIG. 3. The burner may be mounted in any manner required but is shown for ease of illustration suspended above tray 110 lying on floor or base 112.

The multiple flame head burner is capable of burn rate modulation by concurrently adjusting air and fuel pressure over the burn rate range of interest. Burn rate modulation may be continuous or abrupt (high or low rate) depending upon the requirements of the application. A conventional control system (not shown) is used to accommodate the modulation.

By way of illustration, burning rates in the range of 0.1 to 1.0 g.p.h. per nozzle or flame head may conveniently be provided using the burner system at primary air pressures between about 8 and 18 p.s.i.g.

Liquid fuels such as fuel oil which have no measurable vapor pressure at ambient conditions require a means of delivery (not shown). By contrast, most gaseous fuels (e.g., hydrogen, methane, petroleum gases) have a substantial vapor pressure which may be used for fuel delivery or the gaseous fuels may be obtained under pressure from a central delivery system. Although air has been illustrated herein as the dispersion gas, the dispersion gas may itself be a gaseous fuel having significant vapor pressure at ambient conditions such as propane, butane, methane, etc.

Finally, the term air-atomizing nozzle is used throughout the specification and claims in its generic sense as meaning a nozzle, such as the type shown in FIG. 1, in which fuel is prepared for combustion by low-pressure dispersion using a compressible gas (e.g., air) as the dispersing medium. In low-pressure atomization, primary air (gas) is delivered to the nozzles at relatively low pressure (e.g., 1 to 25 p.s.i.g.) and used to atomize fuel also delivered to the nozzles at low pressure (e.g., 1 to 4 p.s.i.g.).

The invention in its broader aspects is not limited to the specific details shown and described, and departures may be made from such details without departing from the principles of the invention and without sacrificing its chief advantages. For example, more sophisticated means may be employed for supplying the liquid fuel to the air-atomizing nozzles such as shown in my U.S. Pat. No. 3,909,188. Accordingly, the invention should not be limited to the single embodiment illustrated above but only as defined in the appended claims.

I claim:

1. A multi-flame air-atomizing fuel burner system comprising a plurality of air-atomizing nozzle means for using primary gas under pressure to disperse fuel, each of said air-atomizing nozzle means including a substantially vertically oriented, open ended atomizer housing, each of said housings having an aperture through which said primary gas is expanded to disperse said fuel, means for delivering liquid fuel to said atomizer housing of each of said air-atomizing nozzle means adjacent said aperture, means for delivering gaseous fuel to said atomizer housing of each of said air-atomizing nozzle means adjacent said aperture, means for selecting the type of fuel delivered to said air-atomizing nozzle means, means for delivering primary gas under pressure through said aperture of each of said air-atomizing nozzle means to disperse one of said fuels so that the dispersed fuel may be ignited in the presence of secondary air to produce a combustion flame, said air-atomizing nozzle means being spaced apart and arranged in a pattern to provide cross-ignition from a single ignited nozzle means, and flame spreader means located downstream of each of said air-atomizing nozzle means in the gaseous or hydroxyl type combustion zone of a combustion flame for stabilizing and shaping said combustion flame.

2. The multi-flame air-atomizing fuel burner system of claim 1 in which said primary gas is air and said primary gas delivery means includes air compressor means.

3. The multi-flame air-atomizing fuel burner system of claim 1 in which the ratio of flame spreader diameter to separation distance between said flame spreader and each of said air-atomizing nozzle means is about 1.

4. The multi-flame air-atomizing fuel burner system of claim 1 in which said means for delivering gaseous fuel to said air-atomizing nozzle means includes means for regulating the flow of gaseous fuel to said air-atomizing nozzle means.

5. The multi-flame air-atomizing fuel burner system of claim 4 in which said means for regulating the flow of gaseous fuel to said air-atomizing nozzle means is a gaseous fuel pressure regulator.

6. The multi-flame air-atomizing fuel burner system of claim 1 in which said means for controlling the type of fuel delivered to said air-atomizing nozzle means comprises valve means.

7. The air-atomizing fuel burner system of claim 1 in which said air-atomizing nozzle means comprises an air aperture having a hydraulic diameter and having an edge with a thickness approximately equal to or less than the hydraulic diameter of said air aperture.

8. The multi-flame air-atomizing fuel burner system of claim 7 in which said hydraulic diameter is about 10 to 30 mils.

9. The multi-flame air-atomizing fuel burner system of claim 1 and further comprising means for igniting the dispersed fuel in the presence of said secondary air to produce said combustion flame in combination with at least one of said air-atomizing nozzle means.

* * * * *